United States Patent [19]

Westbrook et al.

[11] Patent Number: 4,658,565

[45] Date of Patent: Apr. 21, 1987

[54] CAPPING MACHINE

[75] Inventors: Theodore E. Westbrook, Tonawanda; James V. Kent, Alden; David Kuzemsky, West Seneca, all of N.Y.

[73] Assignee: Figgie International Inc., Willoughby, Ohio

[21] Appl. No.: 839,073

[22] Filed: Mar. 13, 1986

[51] Int. Cl.[4] ..... B67B 3/20; B65B 7/28

[52] U.S. Cl. ..... 53/308; 53/317; 53/331.5

[58] Field of Search ..... 53/317, 331.5, 306, 53/308, 300, 334, 318

[56] References Cited

U.S. PATENT DOCUMENTS

| | | | |
|---|---|---|---|
| 2,406,771 | 9/1946 | Hughes | 53/317 X |
| 2,610,779 | 9/1952 | Fouse | 53/317 X |
| 2,810,249 | 10/1957 | Wysocki | 53/317 |
| 3,031,822 | 5/1962 | Dimond . | |
| 3,169,355 | 2/1965 | Hollaway et al. | 53/317 X |
| 3,242,632 | 3/1966 | Dimond | 53/317 X |
| 3,537,231 | 11/1970 | Dimond . | |
| 3,714,760 | 2/1973 | Roberts et al. | 53/317 X |
| 3,760,561 | 9/1973 | Over et al. . | |
| 3,771,284 | 11/1973 | Boeckmann et al. | 53/317 X |
| 4,178,733 | 12/1979 | Dankert . | |
| 4,265,071 | 5/1981 | Smith et al. | 53/331.5 X |
| 4,295,320 | 10/1981 | Willingham | 53/331.5 X |

OTHER PUBLICATIONS

Magna Torque, brochure (Oct. 1983): Alcoa Packaging, P.O. Box 488, Richmond, Ind., U.S.A. 47374.

*Primary Examiner*—Horace M. Culver

*Attorney, Agent, or Firm*—Christel, Bean & Linihan

[57] ABSTRACT

A capping machine for applying plastic screw-on caps (10) having a tamper evident band 38 to flexible sided round containers (12) having a neck provided with a radially extending flange (24) adjacent the open top of the container. The capping machine includes a portion (114) rotatable about a stationary portion (58), the rotatable portion including a plurality of operating stations (116). Each operating station has a chuck (118) and a novel gripping structure (120) capable of firmly engaging the flange (24) on the container to prevent the container from rotating when a cap is being screwed onto the container. The chucks and gripping structures are each provided with cam followers (122, 124) which engage cams (126, 128) and, as the rotatable portion (116) rotates about the stationary portion (58), the chucks and gripping structures will be shifted vertically in time with each other. In addition, the chuck will be caused to be rotated about its own axis due to the interaction of gears (130, 132) and will screw caps onto the containers while the flange on the container is engaged by the gripping structure (120).

9 Claims, 7 Drawing Figures

Fig. 1.
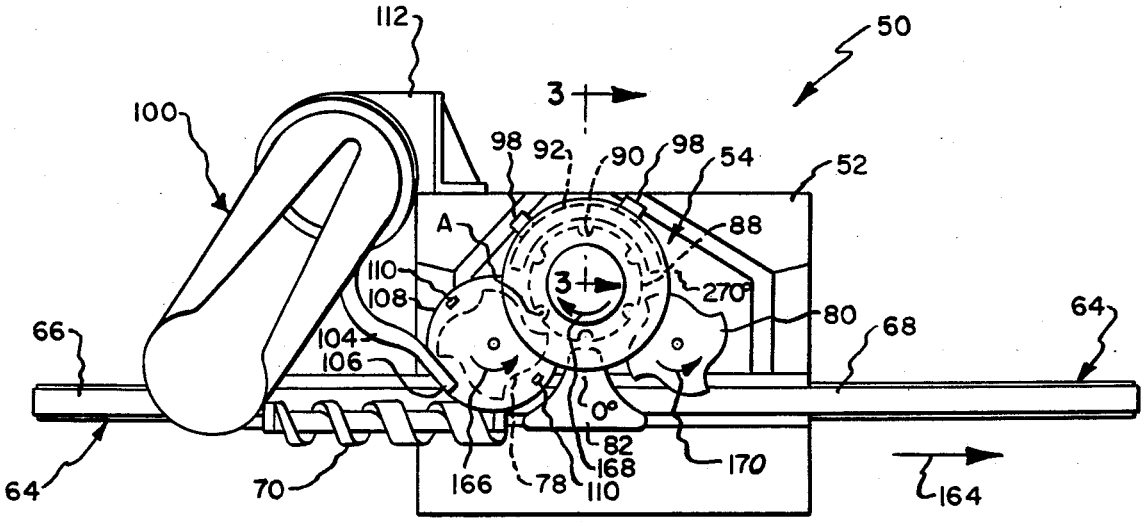
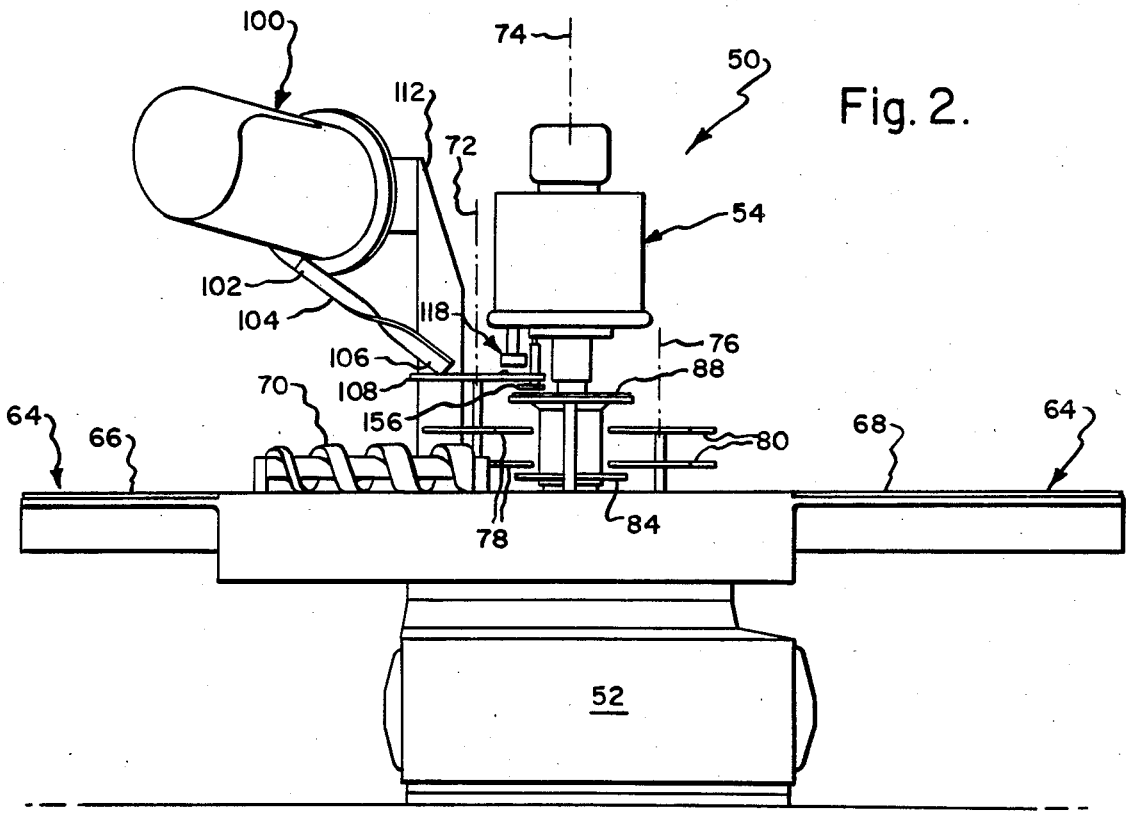
Fig. 2.

Fig. 5.
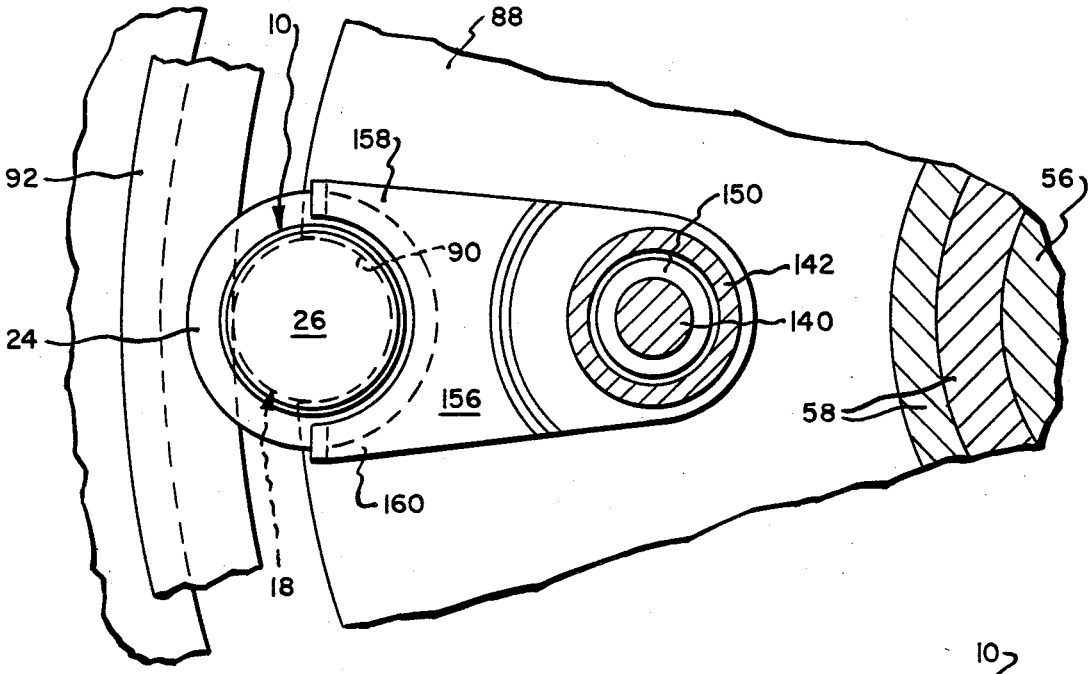
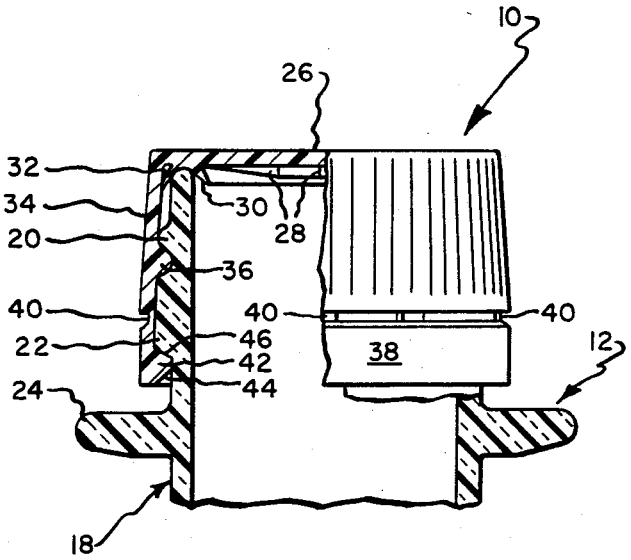
Fig. 7.
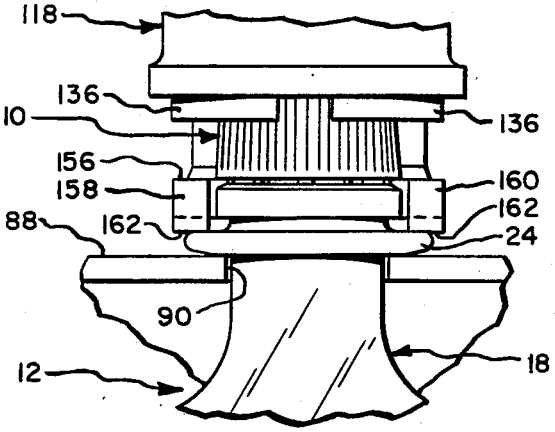
Fig. 6.

CAPPING MACHINE

TECHNICAL FIELD

The present invention relates generally to capping machines and more particularly to a capping machine for applying plastic screw-on caps having a tamper evident band to containers having a neck provided with a radially extending flange adjacent the open top of the container, said capping machine including novel gripping means capable of firmly engaging the flange on the container and preventing the container from rotating when the cap is being screwed onto the container.

BACKGROUND OF THE INVENTION

In the soft drink industry, when reusable glass bottles were the standard container, it was conventional to apply a crown or crimp on cap to the glass bottle after the container had been filled. However, in recent years the soft drink industry has been selling a greater percentage of its output in either nonreusable glass bottles or in PET bottles which are plastic bottles having flexible cylindrical sides and an upper neck provided with a radially extending flange adjacent the open top of the container, a typical example being a two liter container. Three common closures are now used on these containers. The first of these is a cap which is quite similar to the conventional crimp on cap but which can be unscrewed by the user. While this design is widely accepted by the brewing industry, it does have the disadvantage of not showing evidence of tampering. In order to provide the purchaser with evidence of tampering with respect to the soft drinks, two designs provided with tamper evident bands have been widely commercialized. The first of these designs is a plastic cap provided with a heat shrink tamper evident band, the plastic cap being screwed onto the container, the container then being passed through a heating tunnel which causes the tamper evident band to shrink about a collar on the container. When this form of closure is subsequently opened by the user, the tamper evident band is supposed to separate, but almost always stays with closure when removed from bottle. A second form of tamper evident closure also used on both glass containers and PET bottles is a roll on aluminum cap which is in its initial form, a closed cylindrical shape, the cylinder of aluminum being rolled about the threads provided on the container to close it to the container. However, this design also has the disadvantage in that frequently the tamper evident band will not tear away from the upper part of the closure when the container is being opened thus not providing the purchaser with the desired evidence that the contents have been tampered with. Other disadvantages of this form of closure are well known to those skilled in the art. In each of the foregoing tamper evident designs it is customary to apply the closure initially to the container by passing the container underneath the closure wherein the closure is tipped onto the top of the container. This is possible because both the plastic closure having the heat shrink tamper evident band and the aluminum closure which is to be rolled onto the threads of the container initially have relatively large bottom openings which are subsequently reduced in diameter during the closure process.

A third design has been developed which includes both a plastic cap and an integral tear away tamper evident band. As the design has a smaller collar it is necessary to apply the cap axially to the opening of the bottle.

Of course it is well known in the capping industry to apply screw-on caps to glass bottles and metal cans. One well known machine for applying screw-on caps to such containers is illustrated in U.S. Pat. No. 3,537,231 and which is sold under the trade name of CAPEM by Consolidated Packaging Machinery. This form of machine has a turret provided with a number of work stations, each work station being provided with a vertically shiftable and rotatable chuck for applying the closures to the containers, one such chuck being illustrated in U.S. Pat. No. 4,178,733. The machine may be so designed that the chuck picks up the closure from a desired location on a cap pickup plate and then screws it on to the container, the jaws of the chuck being so designed that they will open after the proper torque has been applied to the closure. CAPEM type machines are suitable for applying closures to PET bottles. For example, when applying tamper evident closures of the first two types set forth above, relatively low torques are required to apply these closures and head pressure alone is sufficient to prevent rotation. However, higher torque forces are required when applying the third design of closure or other similar closures, all of which have a relatively small diameter tamper evident band which must be cammed over the tamper evident band retaining ring on the container while the closure is being screwed onto the container. While it is conventional to provide a container engaging device which moves in from the side and engages the container to prevent the container from rotating while a closure is being applied, it is not desirable to use such container engaging devices in the soft drink industry. Thus, it is desirable in the soft drink industry to place the containers as close together as possible on the conveyor within the capping machine to increase the output of the capping machine. This means that each rotatable chuck on the capping machine must be spaced relatively close by to adjacent chucks. However, known container engaging devices which move in from the sides require a greater spacing between chucks than that normally accepted in the soft drink industry. Also such engaging devices are relatively expensive.

OBJECTS AND SUMMARY OF THE INVENTION

It is an object of the present invention to provide a turret type capping machine having a plurality of rotatable chucks, each of which is capable of applying to a PET bottle a screw-on cap or closure having a tamper evident band initially of relatively small diameter, which screw-on cap requires relatively high torque application forces as the cap is being screwed on, said capping machine including vertically shiftable gripping means associated with each chuck and which will engage the neck flange of the PET bottle and which will prevent the PET bottle from rotating as the closure is being screwed on, the gripping means being usable with closely spaced chucks.

It is a further object of the present invention to provide novel gripping means for use in a capping machine of the class described wherein there is one gripping means associated with each chuck which screws the closure onto the container, the gripping means being caused to be moved generally vertically and being provided with a bifurcated presser foot capable of engaging the neck flange of a PET bottle to prevent the container from rotating as the closure is being screwed onto the container.

The foregoing objects as well as additional objects of this invention are accomplished by providing a novel capping machine. The capping machine includes a container transport which includes a linear conveyor having spaced apart inlet and discharge portions, and first, second and third rotatable transfer devices in the form of star wheels, the transfer devices being rotatable about first, second and third generally vertically extending axes and capable of successively transferring individual containers in spaced apart array from the inlet portion to the discharge portion of the linear conveyor. The capping machine further includes cap feeding means including a cap chute and a cap pickup plate which is rotatable about said first axis and which is capable of picking up individual caps from the cap chute and advancing the individual caps to a desired location. The capping machine further includes a capping unit which includes a rotatable portion which is rotatable about the second axis simultaneously with the second transfer device. The capping unit further has a plurality of circumferentially spaced apart operating stations on the rotating portion, each station being associated with one of the containers as it is conveyed by the second rotatable transfer device. Each station includes a chuck mounted for vertical shifting movement and capable of engaging a cap at the desired location on the rotatable cap pickup plate and then positioning the cap onto the open end of a container and screwing the cap onto the container, and then releasing the cap when fully screwed on. Each station further includes novel gripping means which are mounted for generally vertically shifting movement, the gripping means during rotation of the rotatable portion of the capping unit being capable of firmly engaging the flange on a container and preventing the container from rotating while the cap is being screwed onto the container.

The objects set forth above, further additional objects and advantages of this invention, as well as applicants' novel design, will become more fully understood after a consideration of the following detailed description taken in conjunction with the accompanying drawings.

BRIEF DESCRIPTION OF THE DRAWINGS

FIG. 1 is a plan view of a capping machine in which the principles of the present invention may be incorporated.

FIG. 2 is a side elevational view of the capping machine shown in FIG. 1.

FIGS. 5 and 6 are sectional views taken generally along the line 5—5 and 6—6 in FIG. 3.

FIG. 7 is a partial sectional view showing a plastic screw-on cap with a relative narrow tamper evident band fully applied to the top of a PET bottle.

DETAILED DESCRIPTION

Figure 3:
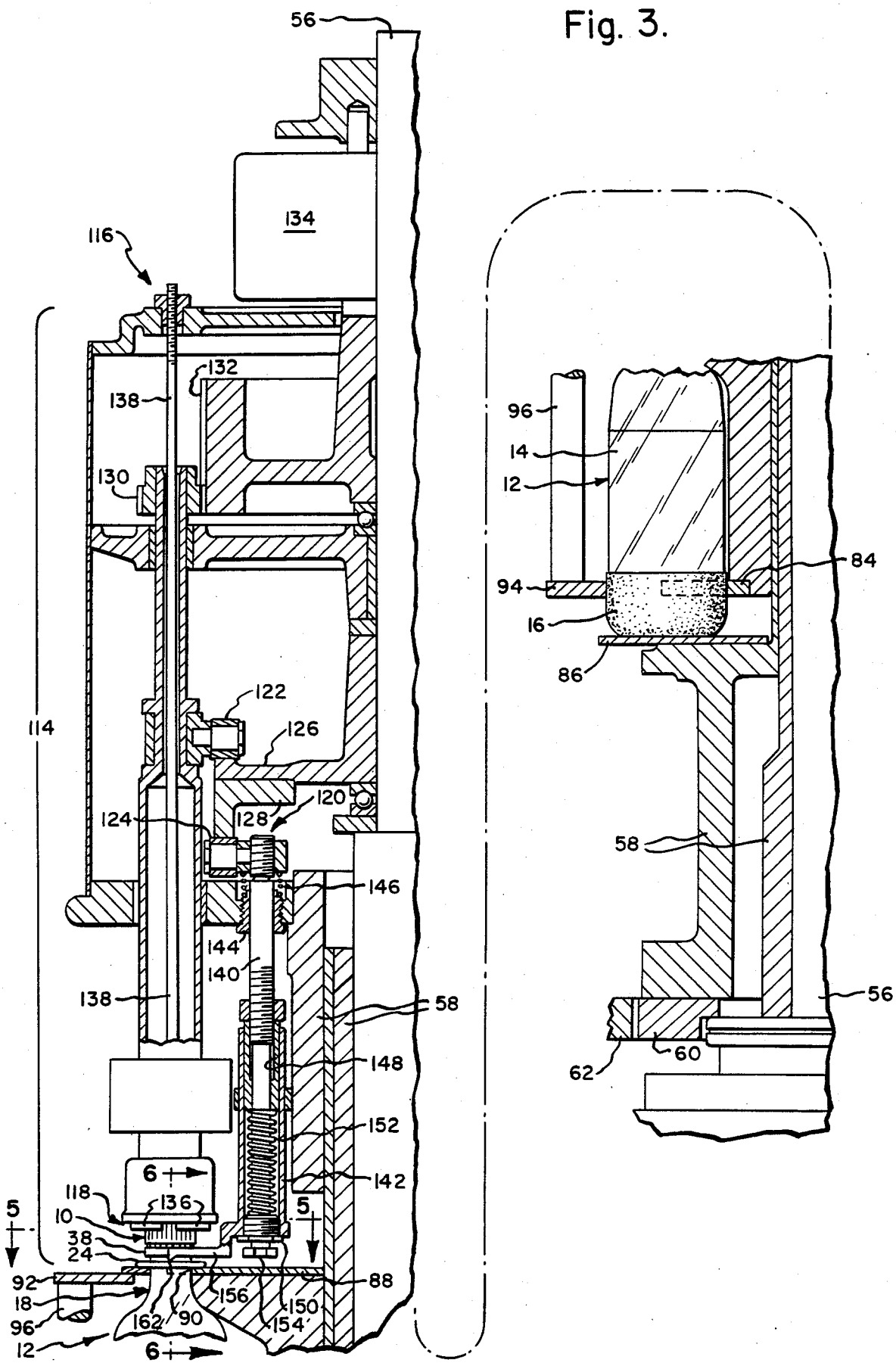
FIG. 3 is a sectional view taken generally along the line 3—3 in FIG. 1, this view showing the chuck means and the gripping means of this invention.

The capping machine of this invention is designed primarily for applying a novel polyethylene screw-on cap or closure, indicated generally at 10 in FIG. 7, to a PET bottle or container indicated generally at 12 in FIGS. 3 and 7. The PET bottle illustrated is of the conventional two liter size and has a generally cylindrical body portion 14 formed of a flexible transparent plastic, a plastic base 16 secured to the bottom of the body portion 14, and a upper neck indicated generally at 18 which is provided with, in descending order, screw threads 20, a tamper evident band retaining ring 22, and a radially outwardly extending flange 24 which is customarily provided to facilitate the carrying of the PET bottle. The cap or closure which may be applied by the capping machine of this invention is preferably formed entirely of molded plastic, preferably polyethylene. However, plastic closures formed of other materials which may be provided with liners, can also be applied by the capping machine of this invention. The crown 26 of the closure 10 is provided with centrally located internal ribs 28 to prevent doming of the crown of the closure and radially spaced apart circumferentially extending sealing flanges 30, 32 which engage the upper edge of the neck 18 of the container to prevent leaking of either the fluid contents or the carbonation gases. The closure further includes a cylindrical portion 34 integral with the crown 26 of the cap, the cylindrical portion being provided with internal threads 36 which may engage the screw threads 20 on the container. Spaced below the cylindrical portion 34 is a tamper evident band 38 which is connected to the cylindrical portion 34 by spaced apart breakable strips of plastic 40. The band 38 is provided with internally extending projections 42, each projection having a lower inclined surface 44 which may be cammed over the ring 22 as the closure 10 is being screwed onto the container 12. The upper surface 46 of each of the projections 42 is also formed with an inclined surface, which inclined surface 46 matches the incline on the lower edge of the ring 22. As this surface extends relatively sharply away from the neck of the container when unscrewing the closure, it will tend to stay below the ring thereby breaking the strips 40 to give evidence that the closure has been at least partially removed from the container. While the conventional two liter PET bottle and a relatively new closure design have been discussed in detail above, these items per se do not form part of the present invention. However, it has been found that when applying the closure 10 to the container 12, sufficiently high torque forces are required so that the container 12 may actually rotate beneath the device which screws on the closure 10 thereby preventing satisfactory closure of the container.

Referring now to FIGS. 1 and 2, a capping machine of this invention is illustrated, the capping machine being indicated generally at 50. The capping machine has three primary functional subsystems, the first being a container transport, the second being a cap feeding assembly, and the third being a capping unit. These devices are all mounted on a base 52 which includes suitable drive motors and controls. Generally centrally mounted upon the base is a turret 54, the lower portion of which forms part of the container transport and the upper portion of which consists essentially of the capping unit. The turret structure includes a vertically extending fixed main spindle 56 (FIG. 3) and a rotatable assembly journalled for rotation about the main spindle 56. The rotatable assembly 58 includes a ring gear 60 which is adapted to be driven by a drive gear 62.

CONTAINER TRANSPORT

The container transport means includes linear conveying means 66 which is conventionally a belt conveyor provided with an inlet portion 66 and a discharge portion 68. Typically, as shown in FIGS. 1 and 2, the inlet portion also includes a helical lead screw or worm 70 which causes individual containers to become closely spaced apart and also held under control as they enter the turret 54. The container transport means further includes first, second and third rotatable transfer means which are rotatable about spaced first, second and third axes 72, 74, 76, respectively. The first and third rotatable transfer means consist of vertically spaced apart star wheels, the star wheels of the first rotatable transfer means being indicated at 78, and the star wheels for the third rotatable transfer means being indicated at 80. These star wheels 78, 80 cooperate with stationary guide means 82 (not shown in FIG. 2) to insure that the containers are properly transported into the turret and from the turret. The second rotatable transfer means includes a star wheel 84, a support plate 86, and disk means 88 which all rotate together. The circumference of the disk means 88 is provided with circumferentially spaced apart cutouts 90, the portion of the disk means adjacent each cutout being partially disposed about the neck and immediately below the neck flange 24 of an associated container 12 during the operation of the capping machine. In order to facilitate the transfer of the containers from the first to the second to the third rotatable transfer means, each of the star wheels 78, 84, 80 is preferably of the same diameter and is caused to have the same peripheral speed. Finally, the container transport means further includes vertically spaced apart upper and lower stationary arcuate guide means 92, 94, respectively, the upper guide means 92 cooperating with the disk 88 to insure that the neck of the container does not move radially away from the turret 54 and to thereby maintain the neck of the container in its proper orientation while a closure is being applied to the container. Similarly, the lower guide 94 cooperates with the star wheel 84 to insure that the base of the container is in its proper position. The guides 92 and 94 are interconnected to each other by rods 96, and brackets 98 (FIG. 1) mount the guides and rods upon the base of the machine.

CAP FEEDING STRUCTURE

The structure by which the caps are fed towards the turret is well known in the art as exemplified by U.S. Pat. No. 3,537,231 and will not be described in great detail. Thus, the cap feeding means may include any conventional cap sorter feeder system 100 which can in turn feed individual caps in proper orientation to the input side 102 of a cap chute 104. The discharge portion 106 of the cap chute means is associated with a rotatable cap pickup plate 108. The cap pickup plate is mounted on the same rotatable shaft which supports star wheels 78 and will rotate with the star wheels. The plate is provided with a number of circumferentially spaced apart cap pickup fingers 110 on its upper surface. As the cap pickup plate rotates in a counterclockwise direction, as viewed in FIG. 1, the cap pickup fingers 110 will engage caps at the discharge portion 106 of the cap chute and convey or advance the caps to a desired location, such as point A in FIG. 1. The cap sorter feeder system 100 and cap chute 104 are supported by a suitable structure 112 which is in turn secured to the base 52 of the capping machine. The structure 112 will also support the drives for the cap sorter feeder system 100.

CAPPING UNIT

As previously noted, the upper portion of the turret 56 includes the capping unit. The capping unit includes a rotatable portion which can be considered to be that portion of the rotatable assembly 58 disposed above the disk 88. In addition the capping means also includes a stationary portion which includes the main spindle 54 and those parts which are secured directly to the spindle for nonrotational movement and which cooperate with the rotatable portion. For convenience the rotatable portion of the capping unit has been designated by reference numeral 114. The rotatable portion 114 has a plurality of circumferentially spaced apart operating stations, one of which is indicated generally by the reference numeral 116 in FIG. 3. Each station will be associated with one of the containers as it is conveyed by the second rotatable transfer means 84, 86, 88. Thus, as illustrated in FIG. 1, if each cutout 90 on disk 88 were to receive a container, six operating stations would be provided. Each operating station includes two major functional subassemblies, one of the subassemblies being a chuck indicated generally at 118 and the other subassembly being gripping means indicated generally at 120. Each subassembly for each operating station is provided with cam follower means, thus the chuck means 118 is provided with cam follower means 122 and the gripping means 120 is provided with cam follower means 124. The stationary portion of the capping means includes stationary first and second cam structures 126, 128, each of the structures 126, 128 being provided with a circular cam track **126*a*, 128*a* concentric with the second axis 74. The cam follower means 122 engages the circular cam track 126*a* and similarly the cam follower means 124 engages the circular cam track 128*a*. As the rotatable portion 114 rotates about the main spindle 56 the chuck means 118 and gripping means 122** will be caused to be vertically shifted due to the engagement of the cam follower means with the cam track means. The vertical shifting movement will be more fully brought out below in a discussion of the operation of the machine.

The chuck means 118 may be of the well known design sold under the trade name TORKOPEN by Consolidated Packaging Machinery and which is illustrated in U.S. Pat. No. 4,178,733 and predecessor patents U.S. Pat. Nos. 3,537,632 and 3,031,882, the subject matter of which is incorporated herein by reference thereto. As this design of chuck is well known to those skilled in the art, its structure is not illustrated in detail and it need only be noted that the chuck is mounted not only for vertical shifting movement but also for rotation about its own axis. The upper end portion of the chuck is provided with a gear 130 which in turn may engage another gear 132 concentric about the axis 74. The gear 132 may be secured directly to the stationary main spindle 56, or it may be driven by a planetary gear box 134 such as type AS6889-1 3/8 available from Consolidated Packaging Machinery. In any event, as the rotatable portion 114 of the capping means rotates about the axis 74 each chuck will be caused to rotate about its own axis in a clockwise direction when viewed from above due to the interaction of gears 130, 132. In addition, the chuck includes movable jaws 136 and a stop rod 138 which does not rotate about the axis of the chuck as do most of the other components of the chuck. Incidentally, it should be noted that the cam follower 122 is also mounted in such a manner that it does not rotate with the chuck about the axis of the chuck.

The gripping means includes in part, a generally vertically extending rod 140 and a vertically shiftable sleeve 142 which is disposed about a lower portion of the rod 140. An upper end portion of the rod 140 is journalled within a bushing 144 for vertical shifting movement, the bushing 144 being carried by a portion of the rotatable assembly 58. The cam follower 124 is supported on the upper end of the rod 140 and a spring 146 biases the cam follower 124 into engagement with the surface 128*a* at all times. Upper and lower guide bushings 148, 150 are disposed between the sleeve 142 and a lower portion of the rod 140 to permit axial sliding movement of the rod and sleeve with respect to each other. The upper guide bushing 148 is carried by the rod and the lower guide bushing 150 is carried by the sleeve means. A spring 152 is disposed within the sleeve 142 and bears against the upper surface of the lower guide bushing 150 and the lower surface of the upper guide bushing 148 to normally bias the sleeve away from the top end of the rod 140. The lower end of the rod 140 is provided with a stop 154 to limit the downward movement of the sleeve 142. In addition, the upper guide bushing 140 is adjustable so that the preload of the compression spring 152 maybe varied.

The gripping means further includes a presser foot which is mounted on the lower end of the vertically shiftable sleeve means 142. The presser foot means 156 has a pair of spaced apart arms 158, 160. A downwardly projecting point 162 is provided adjacent the end of each of the arms 158, 160. The spacing between the arms and their length is such that the arms are capable of straddling the neck of container with the points 162 bearing down against the neck flange 24 with sufficient force to prevent the container 12 from rotating when a cap is being screwed onto the container. In this regard it should be noted that the flange 24 when engaged by the presser foot 56 will be trapped between the presser foot 56, the disk 88, and the stationary arcuate guide 92, the flange being engaged all the time while a cap is being screwed onto the container.

OPERATION

The operation of the capping machine of this invention is as follows: When the machine is started, the linear conveyor will move in the direction indicated by the arrow 164, the first rotatable transfer means 78 will rotate in the direction indicated by the arrow 166 and at the same time the cap pickup plate 108 will also rotate in the same direction and at the same speed. In addition, the second rotatable transfer means 84, 86, 88 and the third rotatable transfer means 80 will rotate in the direction indicated by the arrows 168 and 170, respectively. Containers which have been filled by a filling apparatus will now be conveyed on the inlet portion 66 of the linear conveyor 64 towards the turret 54 until the helical lead screw or worm 70 engages the containers to separate them from each other and to hold them under control as they enter the first rotatable transfer means 78. Meanwhile, the cap sorter feeding system 100 will feed caps in proper orientation to the input side 102 of the cap chute 104 and properly oriented caps are picked up by the cap pickup fingers 110 on the cap pickup plate 108 will be advanced to the desired location A.

Each station of the rotatable portion 114 will be rotated in a clockwise direction as viewed in FIG. 1, and as each station is rotated, the cam surfaces 126*c* and 128*a* on cams 126 and 128 will cause vertical shifting movement of the chuck 118 and the gripping means 120.

Figure 4:
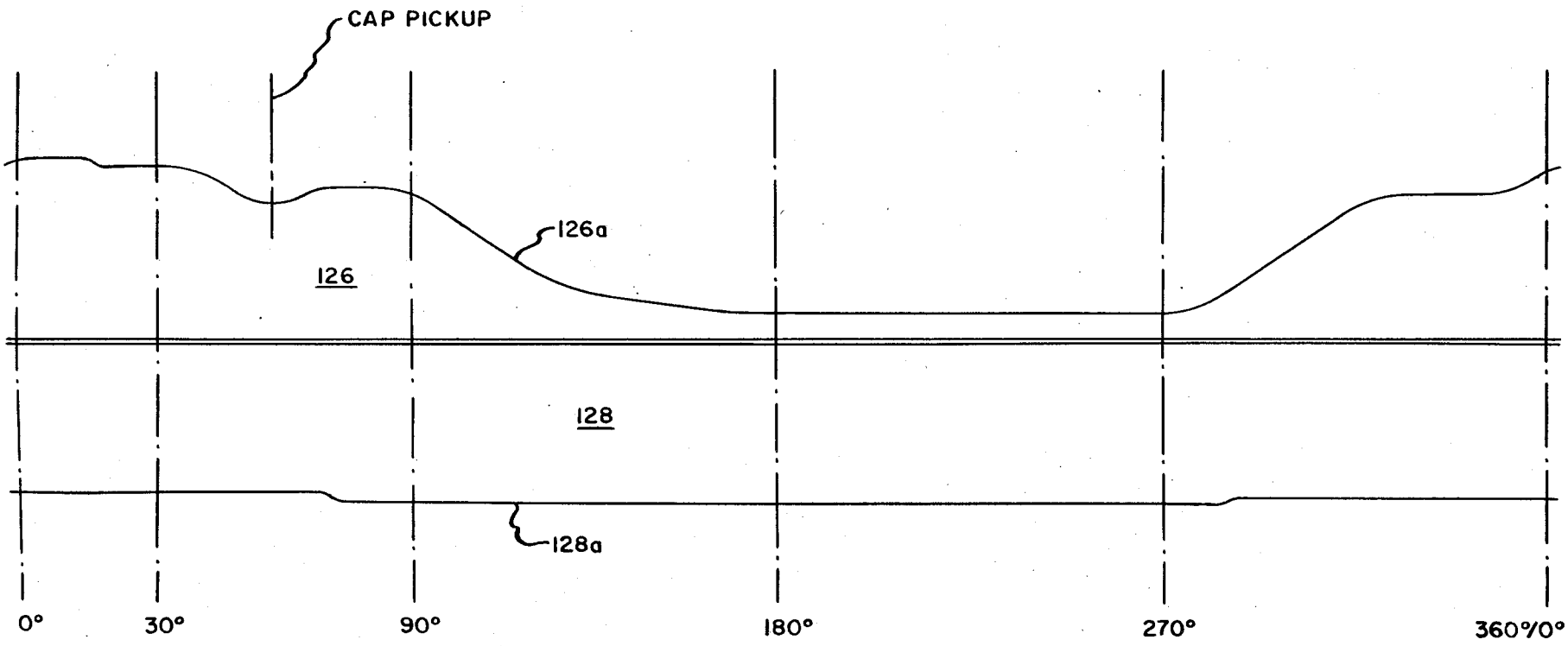
FIG. 4 is a developed profile of the cams which are utilized to vertically shift the chuck means and gripping means shown in FIG. 3.

The operation of the chuck means and gripping associated with a single operating station will now be described. When the chuck and the retaining means are at the 0° position (FIGS. 1 and 4) the chuck will have been reset so that it will open when the desired torque is achieved when screwing on the cap onto the container, and the chuck will also be in an upper position as the cam follower 122 follows cam track 126*a*. In addition, the presser foot 156 will be in its raised position so that the neck flange 24 of a container can be accepted within the cutout 90 on disk 88. As the rotatable portion 114 of the capping unit rotates in the clockwise direction as viewed in FIG. 1, the chuck means 118 will drop due to its own weight as the cam follower 122 follows cam 126*a* until the jaws on the chuck close about a cap on the cap pickup plate at the desired location A, this location being approximately 60° of rotation. As the parts continue to rotate from the 60° position to the 90° position the chuck will be raised slightly so that the cap will clear the fingers 110 on the cap pickup plate 108 and meanwhile the presser foot will be forced downwardly by cam surface 128*a* into engagement with the flange 24 on the container to hold the flange firmly in engagement with the disk 88, the flange also being supported by the upper stationary arcuate guide 92. At about the 90° position, shown in FIG. 4, the chuck will be permitted to descend and as it is in axial alignment with the container the cap will be placed onto the container. As the chuck is also being caused to be rotated by the gearing 130, 132, the cap will be screwed onto the container until the jaws open when the desired torque has been obtained, somewhere before the 270° location. After 270° the chuck will be raised progressively until it attains the 0° position at which point the stop rod 138 will have reset the torquing mechanism within the chuck to permit it to again open when the cycle is repeated. In addition, the presser foot 156 will be caused to be raised between the 270 and 300° location thereby releasing the flange on the container and permitting the container to be accepted by the third rotatable transfer means for discharge onto the discharge portion 68 of the linear conveyor 64.

While a preferred structure in which the principles of the present invention have been incorporated is shown and described above, it is to be understood that this invention is not to be limited to the particular details shown and described above, but that, in fact, widely differing means may be employed in the practice of the broader aspects of this invention.

What is claimed is:

1. A capping machine for applying screw-on caps having a tamper evident band to containers having a neck provided with a radially outwardly extending flange adjacent the open top of the container, said machine including:

container transport means including conveying means having spaced apart inlet and discharge portions, and first, second and third rotatable transfer means, rotatable about spaced apart first, second and third generally vertically extending axes and capable of successively transferring individual containers in closely spaced apart array from the inlet portion to the discharge portion of the conveying means;

cap feeding means capable of picking up individual caps and advancing the individual caps to a desired location; and capping means including a rotatable portion which is rotatable about said second axis simultaneously with said second transfer means, said rotatable portion having a plurality of circumferentially spaced apart operating stations, each station being associated with one of the containers as it is conveying by the second transfer means, and each station including chuck means mounted for generally vertical shifting movement, said chuck means during rotation of the rotatable portion being capable of engaging a cap at the desired location, then positioning the cap onto the open end of the container and screwing the cap onto said container, and then releasing said cap when fully screwed on, and each station further including gripping means mounted for generally vertical shifting movement, said gripping means during rotation of the rotatable portion being capable of firmly engaging the flange on the container to prevent the container from rotating while the cap is being screwed onto the container.

2. The capping machine as set forth in claim 1 wherein said capping means includes a stationary portion provided with first and second circular cam track means concentric with said second axis, and wherein each chuck means is provided with cam follower means engaging said first cam track means, and wherein each gripping means is provided with cam follower means engaging said second cam track means, rotation of the rotatable portion of the capping means causing said chuck means and said gripping means to be vertically shifted due to the engagement of the cam follower means with the cam track means.

3. The capping machine as set forth in claim 2 wherein said gripping means includes bifurcated presser foot means having a pair of spaced apart arms capable of straddling the neck of the container and bearing down against the flange on said container to prevent said container from rotating.

4. The capping machine as set forth in claim 3 wherein each of said pair of spaced apart arms is provided with a downwardly projecting point adjacent its outer end.

5. The capping machine as set forth in claim 3 wherein said container transport means includes disk means rotatable with said rotatable transfer means, the circumference of the disk means being provided with circumferentially spaced apart cutouts, the disk means adjacent each cutout being partially disposed about the neck of an associated container immediately below the flange on the container, said bifurcated presser foot means holding the flange of the container against said disk means and preventing rotation of said container while a cap is being screwed onto said container.

6. The capping machine as set forth in claim 5 wherein said container transport means further includes stationary arcuate guide means operatively disposed between the first and third rotatable transfer means and lying in the same plane as the disk means, said arcuate guide means cooperating with said disk means to maintain the container in its proper alignment with said chuck means and said gripping means as the container is being transported by said second transport means.

7. The capping machine as set forth in claim 3 wherein said gripping means includes a generally vertically extending rod, vertically shiftable sleeve means disposed about a lower portion of said rod, said bifurcated presser foot means being mounted on a lower portion of said sleeve means, upper and lower guide bushings disposed between said sleeve and a lower portion of said rod, spring means operable to normally bias said sleeve means and said presser means downwardly, and stop means carried by the lower end of said rod to limit the downward movement of said sleeve means and said presser foot means.

8. The capping machine as set forth in claim 7 wherein the upper and lower bushing means are carried by said rod and said sleeve means, respectively, the spring means being a compression spring disposed within said sleeve means and between said bushings, and wherein at least one of said bushings is adjustable whereby an initial preload may be imparted to said presser foot means.

9. In combination with a capping machine for applying screw-on caps to containers having a neck provided with a radially outwardly extending flange adjacent the open top of the container, said machine including container transport means including linear conveying means having spaced apart inlet and discharge portions, and first, second and third rotatable transfer means, rotatable about spaced apart first, second and third generally vertically extending axes and capable of successively transferring individual containers in spaced apart array from the inlet portion to the discharge portion of the linear conveying means, cap feeding means including cap pickup plate means rotatable about said first axis and cap chute means having a discharge portion located adjacent the upper surface of said cap pickup plate means, said cap pickup plate means being capable of picking up individual caps from the discharge portion of the cap chute means and advancing the individual caps to a desired location, and capping means including a rotatable portion which is rotatable about said second axis simultaneously with said second transfer means, said capping means having a plurality of circumferentially spaced apart operating stations on said rotatable portion, each station being associated with one of the containers as it is conveying by the second transfer means, and each station including chuck means mounted for generally vertical shifting movement, said chuck means during rotation of the rotatable portion being capable of engaging a cap at the desired location on the rotatable cap pickup plate means, then positioning the cap onto the open end of the container and screwing the cap onto said container, and then releasing said cap when fully screwed on;

the improvement comprising gripping means associated with each operating station and mounted on the rotatable portion for generally vertical shifting movement, said gripping means during rotation of the rotatable portion being capable of firmly engaging the flange on the container and preventing the container from rotating while the cap is being screwed onto the container.

* * * * *